US005809978A

United States Patent [19]

Krimmer et al.

[11] Patent Number: 5,809,978

[45] Date of Patent: Sep. 22, 1998

[54] ADSORPTION FILTER FOR A FUEL-VAPOR RETENTION SYSTEM OF A FUEL TANK OF AN INTERNAL COMBUSTION ENGINE

[75] Inventors: Erwin Krimmer, Pluderhausen; Wolfgang Schulz, Bietighiem-Bissingen; Tilman Miehle, Kernen, all of Germany

[73] Assignee: Robert Bosch GmbH, Stuttgart, Germany

[21] Appl. No.: 836,344

[22] PCT Filed: Jun. 7, 1996

[86] PCT No.: PCT/DE96/00999

§ 371 Date: May 12, 1997

§ 102(e) Date: May 12, 1997

[87] PCT Pub. No.: WO97/10427

PCT Pub. Date: Mar. 20, 1997

[30] Foreign Application Priority Data

Sep. 12, 1995 [DE] Germany ..... 195 33 742.5

[51] Int. Cl.[6] ..... F02M 37/04

[52] U.S. Cl. ..... 123/519; 137/315

[58] Field of Search ..... 123/520, 519, 123/516, 518, 521, 458; 137/315; 251/904

[56] References Cited

U.S. PATENT DOCUMENTS

| | | | |
|---|---|---|---|
| 4,338,106 | 7/1982 | Mizuno | 123/519 |
| 4,552,326 | 11/1985 | Pastrone | 251/904 |
| 5,095,940 | 3/1992 | Saur | 251/904 |
| 5,096,158 | 3/1992 | Burdick | 251/904 |
| 5,267,470 | 12/1993 | Cook | 123/520 |
| 5,337,721 | 8/1994 | Kasuya | 123/519 |
| 5,620,019 | 4/1997 | Nicolaisen | 137/315 |

FOREIGN PATENT DOCUMENTS

| | | | |
|---|---|---|---|
| 4023044 | 1/1992 | Germany | 123/519 |
| 4408429 | 4/1995 | Germany | 123/519 |
| 0013149 | 1/1983 | Japan | 123/519 |
| 0273862 | 11/1989 | Japan | 123/519 |

*Primary Examiner*—Carl S. Miller

*Attorney, Agent, or Firm*—Edwin E. Greigg; Ronald E. Greigg

[57] ABSTRACT

An adsorption filter for a fuel vapor retention system of a fuel tank of an internal combustion engine. The system has a valve that can be connected to an intake tube of the engine via a connecting line that is attached to the valve and to the fuel tank via a tank line. The tank line is attached to a housing of the adsorption filter and the valve is secured on the housing of the adsorption filter so that the valve can be slid into an opening provided in the housing. The adsorption filter according to the invention is suited for a fuel vapor retention system, for mixture compressing internal combustion engines with externally supplied ignition.

20 Claims, 2 Drawing Sheets

ADSORPTION FILTER FOR A FUEL-VAPOR RETENTION SYSTEM OF A FUEL TANK OF AN INTERNAL COMBUSTION ENGINE

PRIOR ART

The invention relates to an adsorption filter for a fuel vapor retention system of a fuel tank of an internal combustion engine. An adsorption filter of this kind is already known (German Patent 44 08 429), which has a recess in order to attach a valve in the recess by means of a fastening element, which valve is used to introduce fuel vapors temporarily stored in the adsorption filter in an intake tube of the engine. The fastening element is embodied in the form of a retaining clip, which is formed onto the wall of the recess, is of one piece with it in the interior of the recess, and essentially corresponds to the size of the valve. The retaining clip encompasses the valve on its outer surface with elastic initial stress. For noise reasons, a closing cap is provided to cover the recess having the valve. The valve accommodated in the recess has an outflow fitting for connecting the valve to the intake tube of the engine via a connecting line. The outflow fitting protrudes laterally from the valve out from the recess of the adsorption filter or the closing cap. The connecting position of the connecting line or the outflow fitting on the valve is thus fixed and cannot be altered. An electrical plug connection for the valve has to be guided through the closing cap into the recess to electrically contact the valve.

Furthermore, a connecting flange is provided in the recess for connecting the valve sealingly to a line that reaches into the adsorption medium. A filter that is low in volume is accommodated in the line and is used to purify the fuel vapors flowing into the valve from the adsorption medium via the line. A low-volume filter of this kind, though, has the disadvantage of being affected relatively quickly by contaminants, in particular charcoal particles from the adsorption filter, by means of which an increased flow resistance is produced in the dirt filter, a filter that filters dirt, which causes a pressure loss and thus a reduction of the through flow quantity of the valve.

The described accommodation of the valve in the recess and the fastening of the valve by means of a retaining clip is costly to embody, in particular in mass production assembly, resulting in high production costs. Furthermore, access to the valve from outside is only possible to a limited degree, in order to exchange it for example for repair purposes, since in this connection, the closing cap must first be removed and the valve must be detached from the retaining clip.

ADVANTAGES OF THE INVENTION

The adsorption filter according to the invention, has the advantage over the prior art that the valve is fastened to the adsorption filter in a particularly simple manner so that a rapid and reliable installation and removal of the valve from the adsorption filter is possible, which permits a reasonably priced kind of manufacture in mass production. To this end, without having to carry out extensive structural alterations, already existing valves can be advantageously used or altered in a simple manner. It is furthermore advantageous that different connecting positions of an outflow fitting of the valve can be set by simply rotating the valve so that it is also possible to accommodate the adsorption filter with the valve in installation zones that are otherwise difficult to reach.

Advantageous improvements and updates of the adsorption filter disclosed are possible by means of the measures embodied herein. Because of a particularly large-surfaced dirt filter built into the adsorption filter or on the valve, the valve can be advantageously protected from contaminants in such a way that a perfect functioning and high operational reliability of the valve is always assured during the provided service life of the valve. Furthermore, only an extremely slight pressure loss is produced by the large-surfaced dirt filter so that a reduction of the through flow quantity of the valve can be prevented.

A sealing plug that is preferably comprised of elastic plastic and is for fastening the valve to the adsorption filter permits a particularly vibration-damped and therefore low-noise fastening of the valve. Furthermore, the sealing plug permits a rapid and reliable installation and removal of the valve from the adsorption filter.

A BRIEF DESCRIPTION OF THE DRAWINGS

Exemplary embodiments of the invention are shown in simplified fashion in the drawings and are explained in detail in the following description.

FIG. 1 shows an adsorption filter according to the invention, with an attached valve in accordance with a first exemplary embodiment according to the invention, FIG. 2 shows a detail of the adsorption filter, with the attached valve in accordance with a second exemplary embodiment, FIG. 3 shows an internal view of the adsorption filter with the view directed at the valve according to FIG. 2 that is attached to the adsorption filter.

DESCRIPTION OF THE EXEMPLARY EMBODIMENTS

Figure 1:
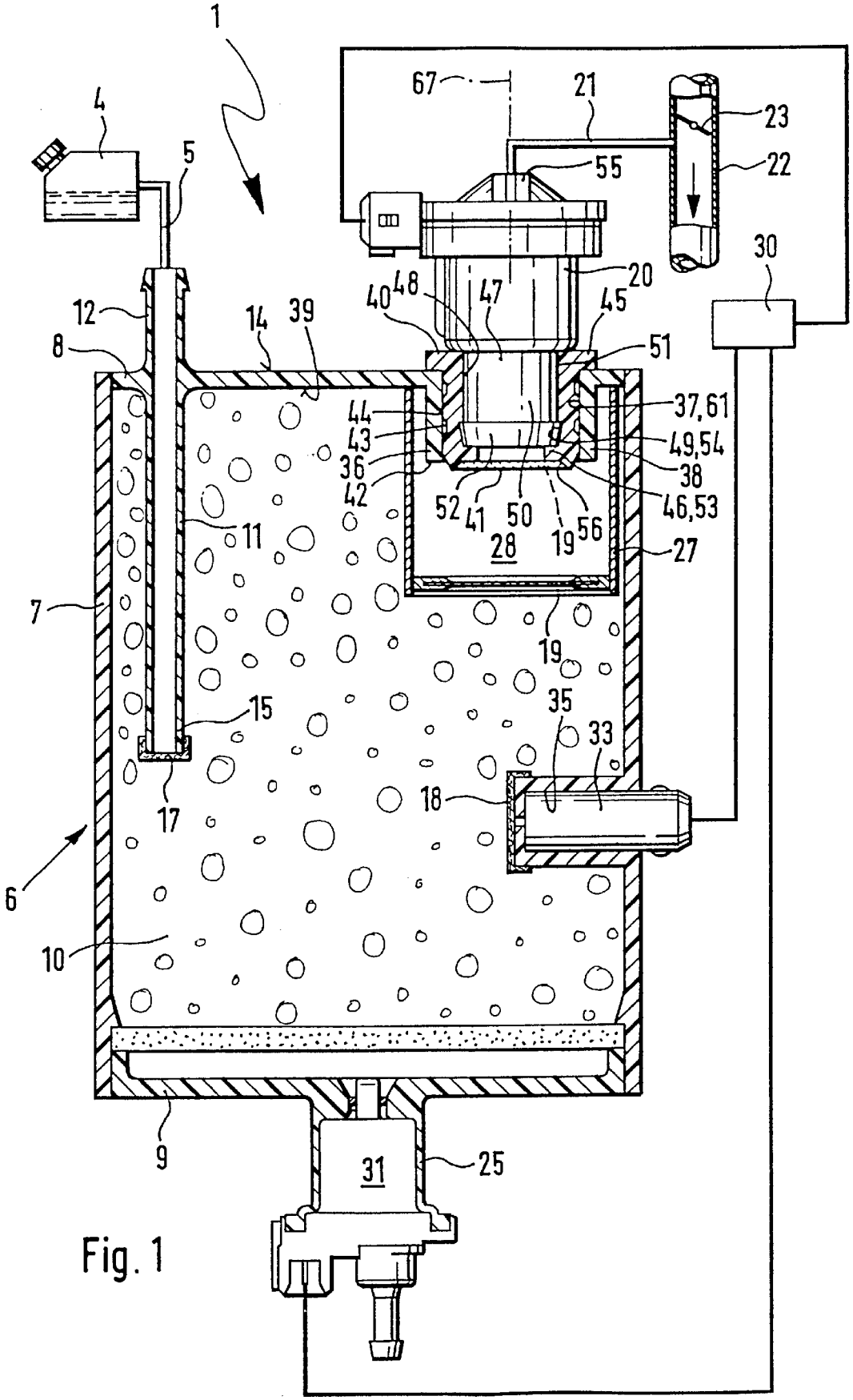

FIG. 1 shows a fuel vapor retention system that is labeled with 1 and is for a fuel tank 4 of a mixture compressing internal combustion engine, not shown in detail, that has externally supplied ignition, which tank is used to supply the engine with fuel. The fuel vapor retention system 1 has an adsorption filter 6 that is connected via a tank line 5 to the fuel tank 4 and filled with an adsorption medium 10, in particular with activated charcoal. The adsorption filter 6 has a main housing 7 that is embodied, for example, as cylindrical and can be closed by an upper housing part 8 and a lower housing part 9 that can both be inserted into the main housing 7. The main housing 7, the upper housing part 8, and the lower housing part 9 are comprised for example of plastic. Via a connection fitting 11, for example formed onto the upper housing part 8 and of one piece with it, the adsorption filter 6 is connected to the fuel tank 4 via the tank line 5. The connecting fitting 11 protrudes with its connecting part 12 beyond an upper end face 14 of the upper housing part 8 and extends from the upper end face 14 into the inside of the adsorption filter 6, approximately to the middle of the main housing 7. In an end part 15 of the connecting fitting 11 disposed on the inside in the adsorption medium 10, a filter 17 is attached to the connecting fitting 11 and is used to purify fuel vapors flowing from the fuel tank 4 via the tank line 5 into the adsorption medium 10.

Furthermore, the fuel vapor retention system 1 has a valve 20 that is also called a regenerating valve or a tank ventilation valve and whose design is known to one skilled in the art, for example from German Patent Disclosure 40 23 044. The valve 20 is connected to an intake tube 22 of the engine via a connecting line 21 that feeds into the intake tube 22 of the engine for example downstream of a throttle valve 23 installed in the intake tube 22. When the engine is in operation, a vacuum prevails in a known manner in the intake tube 22, with the aid of which the fuel vapors are aspirated from the fuel tank 4 when the valve 20 is open. The fuel vapors travel from the fuel tank 4 via the tank line 5 into the adsorption filter 6 and from this via the valve 20 into the connecting line 21, wherein ambient air is aspirated via a ventilation connection 25 provided on the adsorption filter 6 by means of the vacuum in the intake tube 22 so that the fuel vapor temporarily stored in the adsorption filter 6 is entrained in the ambient air. The fuel vapors temporarily stored in the adsorption filter 6 mix with the ambient air flowing in via the ventilation connection 25. Via the valve 20, which is for example embodied so that it can be electromagnetically actuated, and is cyclically triggered by an electronic control device 30, the fuel vapors travel from the valve 20 via the connecting line 21 into the intake tube 22, to then is combusted in at least one combustion chamber of the engine.

To leak test the fuel vapor retention system 1, another valve 31, called a stop valve, is provided at the ventilation connection 25 and can open and close the ventilation connection 25 in relation to the atmosphere. The stop valve 31 is for example also embodied so the stop valve can be electromagnetically actuated and can be triggered by the electronic control device 30. For leak testing the fuel vapor retention system 1, the stop valve 31 is closed and the valve 20 is opened so that the vacuum prevailing in the intake tube 22 during the operation of the engine can be set in the fuel tank 4, in the adsorption filter 6 as well as in the tank line 5 and the connecting line 21. Then the valve 20 is closed. If the fuel tank 4, the adsorption filter 6, the tank line 5, and the connecting line 21 have no leaks, then the vacuum is maintained. If one of these components or a flow connection of the fuel vapor retention system 1 has a leak, then the air flowing in leads to a pressure balancing in the fuel vapor retention system 1, a pressure sensor 33 detects this and transmits corresponding electrical signals to the electronic control device 30. The pressure sensor 33 is accommodated, for example, in a lateral recess 35 of the main body 7 in the adsorption filter 6 and measures, protected by a filter 18, the pressure in the inner chamber of the adsorption filter 6. The pressure sensor 33, as well as the valve 20 and the stop valve 31, is connected to the electronic control device 30 via electrical lines.

According to the invention, the valve 20 can be plugged into the adsorption filter 6, for which an opening 37 is provided in the upper housing part 8. The inner wall 61 of the opening 37 is comprised of a recess 38 in the upper housing part 8, which recess is formed, for example, out of the upper housing part 8 and of one piece with it so that a sleeve-shaped part 36 is produced, which protrudes from an inner face 39 of the upper housing part 8, remote from the upper end face 14, and extends partway into the interior of the main body 8 or the interior of the adsorption filter 6. However, it is also possible to embody the recess 38 in the form of a sleeve attached to the inner surface 39, which extends the opening 37 from the end face 14 into the interior of the adsorption filter 6.

The recess 38, which is similar to a section of pipe and is for example cylindrical, is used to receive a hollow sealing plug 40, which is inserted at least partway into the recess 38 through the elastic deformation of its outside. In the inserted state, this plug protrudes, for example, with its annular face 41 that is disposed on the interior of the adsorption filter 6, slightly beyond the annular face 42 of the recess 38 that is disposed on the interior of the adsorption filter 6. The sealing plug 40 has a collar 45 that serves as a stop and rests against the upper end face 14 of the upper housing part 8 when the sealing plug 40 is inserted in the recess 38.

For example, the hollow sealing plug 40 has a circular internal opening 47 in order to receive the valve 20 with a cylindrically embodied inflow fitting 50 so that it can slide in the internal opening 47. To this end, at least one circumferential groove 49 is let into a wall 48 of the internal opening 47 of the sealing plug 40, which groove has a face 54 that is inclined diagonally to a longitudinal axis 67 of the recess 38 and conically extends toward the lower housing part 9 reducing the cross section and ends at a circumferential intermediary piece 46 in the internal opening 47. The intermediary piece 46, which reduces the opening cross section of the internal opening 47 and forms an internal stop 53 for the inflow fitting 50 of the valve 20 in the internal opening 47 of the sealing plug 40.

To receive the valve 20 so it can slide in the groove 49, the inflow fitting 50 has an edge bead 52, which continuously protrudes from an outer surface 51 of the inflow fitting 50 of the valve 20 and tapers conically in the axial direction toward the intermediary piece 46 so that the edge bead 52 is shaped like a truncated cone in order to widen the internal opening 47 slightly when the inflow fitting 50 is introduced into the sealing plug 40 that for example has already been inserted in the recess 38 until the internal stop 53 in the sealing plug 40 is reached. The edge bead 52 snaps into the groove 49, which has a cross section embodied in accordance with the edge bead 52, and thus engages the valve 20 in the sealing plug 40. The ability of the valve 20 to rotate in the sealing plug 40 is maintained and for this purpose, the plug is comprised of elastic material, for example plastic or rubber.

It is also possible to first place the sealing plug 40 over the inflow fitting 50 of the valve 20 in order to guide it along with the valve 20 into the recess 38. The sealing plug 40, which is preferably comprised of elastic plastic, permits a particularly vibration-damped fastening of the valve 20 in the recess 38 so that noise emissions of the valve 20 are reduced. Furthermore, the sealing plug 40 permits a rapid and reliable installation and removal of the valve 20 from the adsorption filter 6. According to an embodiment not shown, the inflow fitting 50 of the valve 20 can also be sealingly inserted and secured in the opening 37 of the recess 38 made of plastic without the interposition of the sealing plug 40.

On the inside of the adsorption filter 6, the sleeve-shaped recess 38 is additionally encompassed, for example, by a filter sleeve 27 that is larger in diameter and is attached, for example, to the inner wall 39 of the upper housing part 8 or formed onto this upper housing part and of one piece with it. The filter sleeve 27 is provided for securing a large-surfaced filter 19, which is used to purify the fuel vapors temporarily stored in the adsorption medium 10 and to this end, has a mesh width of a few micrometers. The filter 19 can be stretched onto an end face of the filter sleeve 27 parallel to the annular face 41, however it can also encompass the recess 38 like a basket in a manner not shown. When the valve 20 is open, the fuel vapors flow from the adsorption medium 10 through the filter 19 into a chamber 28 defined by the filter sleeve 27, the inner wall 39 of the upper housing part 8, and the filter 19. From the chamber 28, the fuel vapors flow further via the internal opening 47 of the sealing plug 40 into the inflow fitting 50 of the valve 20 in order to finally travel into the connecting line 21 and into the intake tube 22 in a cyclical manner via an outflow fitting 55, not shown in detail, provided on the opposite end of the inflow fitting 50. However, it is also possible, as shown with dashed lines in FIG. 1, to attach the filter 19 directly to the sealing plug 40 in lieu of the filter sleeve 27. To this end, the filter 19 can be introduced for example in a filter groove 56, which is provided between the intermediary piece 46 and the annular face 41, and is fastened in this groove on the sealing plug 40, for example by means of welding. It is also possible to fasten the filter 19 to the recess 38 for example on the annular face 42. To elastically secure the valve 20 in the recess 38 and to further improve the noise damping of the valve 20, an outer surface 44 of the sealing plug 40 can additionally have a circumferential groove 43 or a number of circumferential grooves 43.

Figure 2:
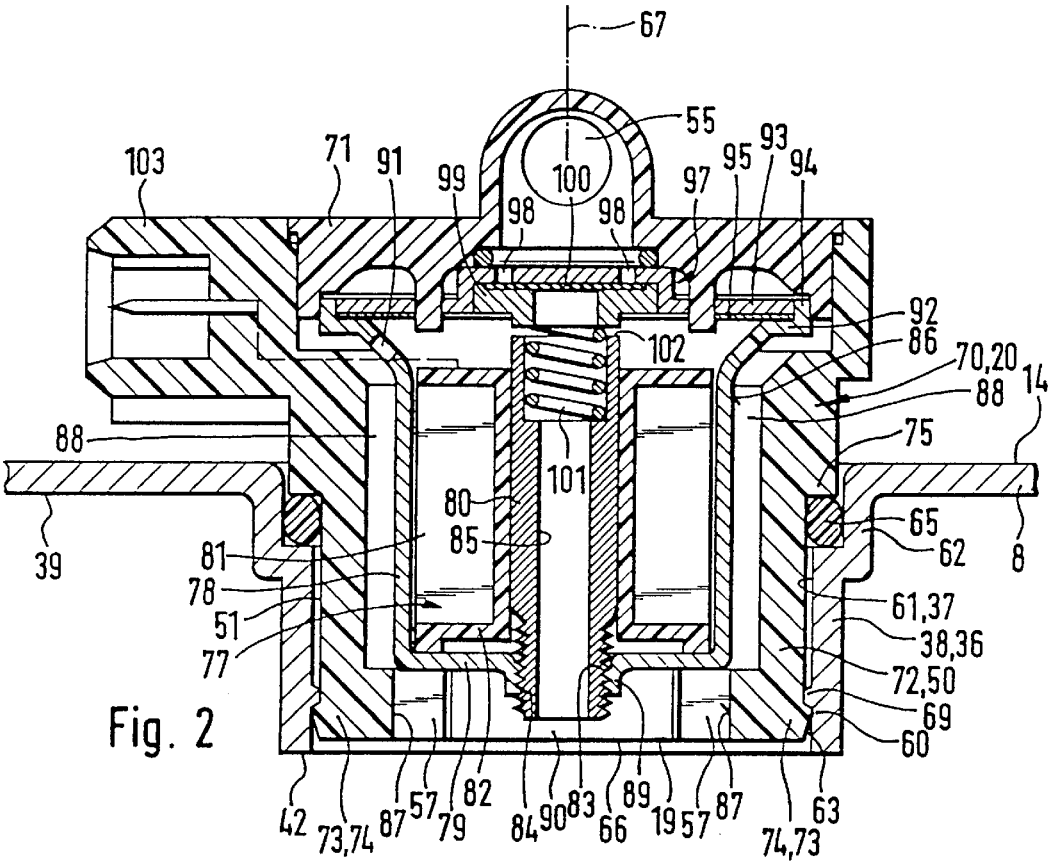

FIG. 2 shows a second exemplary embodiment according to the invention of the fuel vapor retention system 1, in which all identical or identically functioning parts are given the same reference numerals as in the first exemplary embodiment according to FIG. 1. The valve 20 shown in section in FIG. 2 has a two-part valve housing 70 with a cap-shaped upper valve housing part 71 and a sleeve-shaped lower valve housing part 72, which essentially comprises the inflow fitting 50 of the valve 20. The cap-shaped valve housing part 71 can be inserted into the sleeve-shaped valve housing part 72. Both valve housing parts 71, 72 are preferably comprised of plastic and are for example welded to each other.

Figure 3:
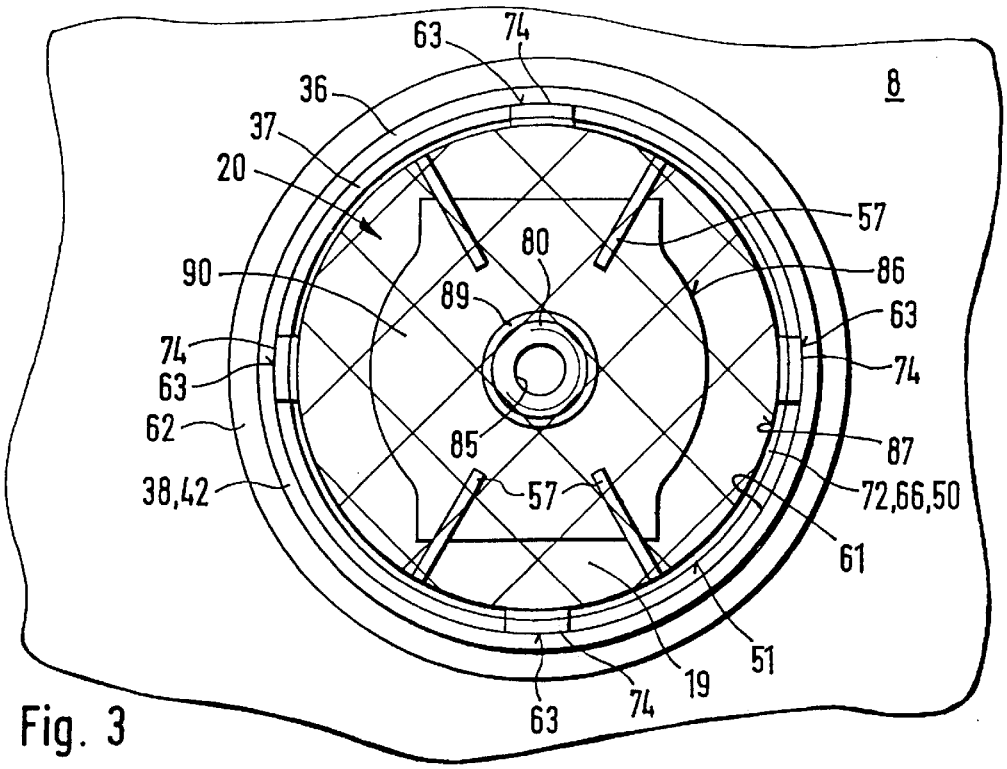

In lieu of the sealing plug 40 shown in FIG. 1, a detent connection shown in FIGS. 2 and 3 is provided on the valve 20 for securing it in the recess 38, which is why an end region 73 of the sleeve-shaped valve housing part 72 has for example four detent sections 74. As shown in FIG. 3, the internal view of the adsorption filter 6 with the view directed at the valve 20 engaged in detent fashion in the recess 38, with short radial extension and short extension in the circumference direction, the detent sections 74 extend in the form of a bead on the circumference of the outer face 51 of the sleeve-shaped valve housing part 72 with an approximately 90° angular spacing from one another. As shown in the sectional view of the valve 20 in FIG. 2, the detent sections 74 also have only a relatively short extension in the axial direction, in order to only slightly thicken the outer face 51 of the sleeve-shaped valve housing part 72 thus permitting an easy introduction of the valve housing part 72 into the recess 38. The detent sections 74, which have a barbed cross section, have protruding detent surfaces 63, which are inclined diagonally to the longitudinal axis 67 and extend conically in the axial direction. When the valve 20 is introduced into the recess 38, the end region 73 of the valve housing part 72 provided with the detent sections 74 slides with radial initial stress in the inner wall 61 of the recess 38 until a cross section reducing internal bead 69 in the inner wall 61 of the recess 38 is reached, in order to engage in detent fashion counter to this initial stress, with the detent sections 74 in a detent groove 60 let into the circumference of the inner wall 61. To this end, the detent groove 60 has a cross section embodied in accordance with the detent face 63. The valve 20 can be rotated in the recess 38 in order to permit different connection positions of the outflow fitting 55 on the valve 20 due to the rotation of the valve 20 engaged in detent fashion in the recess 38.

The inner wall 61 of the recess 38 shown in FIG. 2 is stepped toward the upper end face 14, or has a discontinuously increasing opening cross section, on the one hand, in order to form a stop for the valve 20 between a step 62 in the inner wall 61 and a shoulder 75 that increases the cross section of this inflow fitting 50 and is disposed on the outer face 51 of the inflow fitting 50, and on the other hand, in order to receive a sealing ring 65 between the outer face 51 of the sleeve-shaped valve housing 72 or the shoulder 75 and the step 62. The sealing ring 65 is slightly deformed upon the introduction of the valve 20 into the recess 38 and remains in a slightly crushed state even after the complete insertion of the valve 20 into the recess 38, which produces an axial initial stress against the inner bead 69 by the detent sections 74 engaged in the detent groove 60, which prevents a detachment of the valve 20 and thus permits the valve 20 to be reliably secured in the recess 38.

The valve 20 shown in section in FIG. 2 has a design that essentially corresponds to that of the valve shown in German Patent Disclosure 40 23 044 and its disclosure is intended to be a component of the current patent application. The design of the valve 20 is only discussed briefly below. The cap-shaped valve housing part 71 has an outflow fitting 55, which for example is formed onto the valve housing part 71 of one piece with it and is used for the slidable reception of the connecting line 21. The outflow fitting 55, not shown in detail, is embodied as cylindrical and protrudes laterally at an angle from the cap-shaped valve housing part 71. An electromagnet 77 is disposed inside the sleeve-shaped valve housing part 72. This magnet has a cup-shaped magnet housing 78 with a coaxial, hollow cylindrical magnet core 80, which passes through a bottom 79 of the magnet housing 78, and a cylindrical excitation coil 81, which rests on a coil carrier 82, for example comprised of plastic, and is disposed in the magnet housing 78, encompassing the magnet core 80. An outwardly protruding threaded fitting 89 that has an internal thread 83 is embodied on the bottom 79 of the magnet housing 78, and an externally threaded section 84 on the hollow cylindrical magnet core 80 is screwed into it.

By rotating the magnet core 80, it can be moved axially in the magnet housing 78. The magnet core 80 has an axial through opening 85 defined by the hollow magnet core 80 so that fuel vapor can flow in the through opening 85 from the inflow fitting 50 to the outflow fitting 55. The magnet housing 78 with the magnet core 80 is inserted in the sleeve-shaped valve housing part 72 so that axial conduits 88 remain between an outer jacket 86 of the magnet housing 78 and an inner wall 87 of the sleeve-shaped valve housing part 72, which conduits are offset to one another in the circumference direction by the same angle so that the sectional view of FIG. 2 shows only two diametrically disposed axial conduits 88. On one end, the axial conduits 88 communicate with the outflow fitting 55 via an annular chamber 90 defined by the annular face 42 of the recess 38 and the bottom 79 of the magnet housing 78. On the other end, the axial conduits 88 communicate with the interior of the magnet housing 78 via bores 91 that are let into the magnet housing 78 in the vicinity of the open end of the magnet housing 78. By means of these axial conduits 88, fuel vapor coming into the inflow fitting 50 can also flow around the magnet housing 78 and can thus dissipate heat generated there.

The free edge of the magnet housing 78 is angled outward to an annular support flange 92, which is bent at the end into an axially protruding annular piece 94. The support flange 92 is used to receive a back end yoke 93, which at least partially covers the magnet housing 78 and on its edge, rests against the annular piece 94. An additional leaf spring 95 made of non-magnetic material is clamped between the support flange 92 and the back end yoke 93 and carries the armature of the electromagnet 77. The electromagnet 77 is used for the cyclical switching of a seat valve 97 that for example has a double valve seat 98. The double valve seat 98 cooperates with a valve member in the form of an annular disk 99 made of magnetic material, which at the same constitutes the armature of the electromagnet 77.

On its end oriented toward the double valve seat 98, the annular disk 99 carries a rubber seal 100, which is pressed against the double valve seat 98 when the seat valve 97 is closed. The free end face of the magnet core 80 forms a stop 102 for the stroke motion of the annular disk 99. By means of the adjusting thread formed by the internal thread 83 and the externally threaded section 84, the stop 102 can be axially moved and as a result, the through flow quantity with a maximally opened seat valve 97 can be determined. The valve closing spring 101 is sized small because when there is a pressure difference between the outflow fitting 55 and inflow fitting 50, a suction effect is exerted on the annular disk 99 in the closing direction and the valve closing action of the valve spring 101 is supported.

When the electromagnet 77 is without current, the seat valve 97 is closed, since the valve closing spring 101 presses the annular disk 99 with its rubber seal 100 against the double valve seat 98. During operation of the engine, the electromagnet 77 is cyclically triggered by the control electronics of the electronic control device 30, to which end an electrical plug connection 103, which is formed onto the sleeve-shaped valve housing part 72 and is of one piece with it, is provided for electrically contacting he valve 20. The clock sequence frequency is predetermined by the operational state of the engine so that the through flow quantity in evaporated fuel vapor crossing over via the seat valve 97 from the inflow fitting 50 into the outflow fitting 55 can be metered accordingly.

As shown in FIG. 3, for example four struts 57 are embodied on the inner wall 87 of the sleeve-shaped valve housing part 72, which protrude radially from the inner wall 87 and have for example a radial extension of approximately one fourth of an inner diameter of the sleeve-shaped valve housing part 72. In the axial direction, the struts 57 extend from the bottom 79 of the magnet housing 78 to an annular face 66 on the end of the sleeve-shaped housing part 72. The struts 57 are used for securing a large-surfaced filter 19 shown in FIG. 3, which radially covers the sleeve-shaped valve housing part 72 and has a mesh width of for example less than 50 micrometers. The fastening of the filter 19 can be carried out by gluing or welding it for example to the annular face 66 and/or to the struts 57 of the valve 20. However, it is also possible to fasten a filter 19 of this kind to the annular face 42 of the recess 38, for example by gluing or welding. It is also conceivable to attach a sleeve to the recess 38, which is spanned by a filter cloth.

The foregoing relates to preferred exemplary embodiments of the invention, it, being understood that other variants and embodiments thereof are possible within the spirit and scope of the invention, the latter being defined by the appended claims.

We claim:

1. An adsorption filter for a fuel vapor retention system of a fuel tank of an internal combustion engine, which comprises a valve that is connected to an intake tube of the engine via a connecting line (21), one end of said connecting line is attached to the valve and another end of said connecting line is connected to the intake tube (22), the fuel tank is connected via a tank line that is attached at one end to said fuel tank and at another end to a housing of the adsorption filter, the valve (20) is secured in the housing (8) of the adsorption filter (6) so that the valve can be slid into an opening (37) provided in the housing (8) and be secured therein, the housing (8) of the adsorption filter (6) has a recess (38) that constitutes the opening (37) in the housing (8), the recess extends partially into an inside of the adsorption filter (6), said valve (20) is secured in the opening (37) by means of a surrounding sealing plug (40) that is inserted into the opening (37) and which is placed relative to an inflow fitting (50) of the valve (20), and said valve is secured coaxially with said sealing plug and said recess (38).

2. An adsorption filter for a fuel vapor retention system of a fuel tank of an internal combustion engine, which comprises a valve that is connected to an intake tube of the engine via a connecting line (21), one end of said connecting line is attached to the valve and another end of said connecting line is connected to said intake tube (22), the fuel tank is connected to a housing of the adsorption filter via a tank line that is attached at one end to said fuel tank and an another end to said housing of the adsorption filter, the valve (20) is secured in the housing (8) of the adsorption filter (6) so that the valve can be slid into an opening (37) provided in the housing (8) by a recess (38) formed by the housing (8) of the adsorption filter (6), the recess (38) constitutes the opening (37) in the housing (8) and extends partially into an inside of the adsorption filter (6), and an inner wall (61) of the recess (38) has means (60) provided for a detent connection of the valve (20).

3. An adsorption filter according to claim 2, in which the recess (38) is formed of one piece with the housing (8) of the adsorption filter (6), which housing is comprised of plastic.

4. An adsorption filter according to claim 2, in which the recess (38) is embodied in the form of a sleeve that is attached to an inner surface (39) of the housing (8).

5. An adsorption filter according to claim 2, in which the valve (20) is secured so that the valve can rotate in the opening (37) of the adsorption filter (6).

6. An adsorption filter according to claim 2, in which the valve (20) is embodied so that the valve is electromagnetically actuated.

7. An adsorption filter according to claim 1, in which the recess (38) is formed of one piece with the housing (8) of the adsorption filter (6), which housing is comprised of plastic.

8. An adsorption filter according to claim 1, in which the recess (38) is embodied in the form of a sleeve that is attached to an inner surface (39) of the housing (8).

9. An adsorption filter according to claim 1, in which the sealing plug (40) is comprised of an elastic material.

10. An adsorption filter according to claim 9, in which the sealing plug (40) has an internal opening (47) which has at least one circumferential groove (49), in which a bead-shaped end (52) of said inflow fitting (50) engages for a detent connection.

11. An adsorption filter according to claim 2, in which detent sections (74) on said inflow fitting (50) engage said detent means (60) for a detent connection to an end region (73) of the inflow fitting (50) of the valve (20).

12. An adsorption filter according to claim 11, in which the detent sections (74) protrude in a bead shape from an outer face (51) of the valve (20).

13. An adsorption filter according to claim 11, in which the detent sections (74) have a barbed cross section.

14. An adsorption filter according to claim 12, in which the detent sections (74) have a barbed cross section.

15. An adsorption filter according to claim 2, in which the recess (38) has a step (62) that enlarges a cross section of the opening (37) toward an outer face (14) of the adsorption filter (6).

16. An adsorption filter according to claim 1, in which the recess (38) is encompassed by a sleeve (27) with a larger cross section, which sleeve proceeds from an inner face (39) of the adsorption filter (6) and covers the recess (38) with a filter (19).

17. An adsorption filter according to claim 1, in which an end of the recess (38), disposed on an inside of the adsorption filter (6), is covered by a filter (19).

18. An adsorption filter according to claim 1, in which a filter (19) is attached to the inflow fitting (50) of the valve (20).

19. An adsorption filter according to claim 1, in which the valve (20) is secured so that the valve can rotate in the opening (37) of the adsorption filter (6).

20. An adsorption filter according to claim 1, in which the valve (20) is embodied so that the valve is electromagnetically actuated.

* * * * *